United States Patent [19]

Lyons

[11] 4,262,905

[45] Apr. 21, 1981

[54] PAPERBOARD TOY PROJECTOR

[75] Inventor: Russell J. Lyons, Franklin Park, Ill.

[73] Assignee: Champion International Corporation, Stamford, Conn.

[21] Appl. No.: 108,020

[22] Filed: Dec. 28, 1979

[51] Int. Cl.[3] ..... A63B 71/00

[52] U.S. Cl. ..... 273/129 W; 273/90; 273/87.4

[58] Field of Search ..... 273/129 R, 127 B, 87.2, 273/87.4, 89, 90, 26 A, 129 W; 124/79, 16; 46/145, 128

[56] References Cited

U.S. PATENT DOCUMENTS

| | | | |
|---|---|---|---|
| 1,080,670 | 12/1913 | Zimmerman | 124/16 |
| 1,299,520 | 4/1919 | Thalinger | 273/89 |
| 2,462,170 | 2/1949 | Dube | 273/90 |
| 2,730,368 | 1/1956 | Martin et al. | 124/16 |
| 2,859,969 | 11/1958 | Modica, Jr. | 273/89 |
| 3,596,648 | 8/1971 | Severs, Jr. | 124/16 |
| 4,078,800 | 3/1978 | Goldforb | 273/89 |

*Primary Examiner*—Richard C. Pinkham
*Assistant Examiner*—T. Brown
*Attorney, Agent, or Firm*—Evelyn M. Sommer

[57] ABSTRACT

A toy is constructed of paperboard, such as carboard, and includes a body member decorated as a sports player, such as a golfer or baseball player. A flat projectile member is held in a slit in the body member and propelled by the child's operation of a paperboard flipper arm which is connected to the body member.

5 Claims, 4 Drawing Figures

PAPERBOARD TOY PROJECTOR

BACKGROUND OF THE INVENTION

The present invention relates to toys and more particularly to paperboard figures used as promotional toys.

At the present time many toys are intended to be sufficiently low in cost so that they may be given away by stores or airlines or as party favors. Such toys may be made of various materials such as plastic, metal and paperboard. However, frequently, to be low in cost, they do not have parts which move. For example, cut-out cardboard dolls generally do not have moving operative parts. Consequently, such toys may be of limited interest to children, especially young boys who may prefer toys they can manipulate.

On the other hand, those toys which do involve moving parts may be relatively costly or complicated or may be easily damaged by the child so as to become inoperative.

SUMMARY AND OBJECTIVES OF THE INVENTION

In accordance with the present invention a paperboard toy is presented in which a body member is printed and cut to resemble a figure playing a sport. A projectile, which is a flat member, is temporarily held in a slit in the body member. The child, using his thumb, flicks a flipper arm on the rear of the body member to propel the flat projectile.

It is an objective of the present invention to provide a paperboard toy having a moving part which toy would entertain a child and yet will be relatively low in cost.

It is a further objective of the present invention to provide such a toy with a flipper arm which propels a projectile, such as a disc, printed to resemble a baseball or golf ball.

It is a further objective of the present invention to provide such a toy with a flipper arm that may be quickly moved forward, using the child's thumb, while the toy is held by the other fingers of the same hand.

It is a still further objective of the present invention to provide such a toy which does not require assembly by the user, which is easy to operate and which is relatively durable.

It is a further objective of the present invention to provide such a toy in which the flipper arm swings back into its initial position due to a paperboard fold (score) line and without using a rubber band or spring.

BRIEF DESCRIPTION OF THE DRAWINGS

Other objectives and advantages of the present invention will be apparent from the detailed description of the preferred embodiment thereof, taken in conjunction with the accompanying drawing. In the drawing, like-referenced numerals indicate like structure throughout the several views showing the paperboard toy of the present invention.

In the drawing.

DETAILED DESCRIPTION OF THE INVENTION

Figure 1:
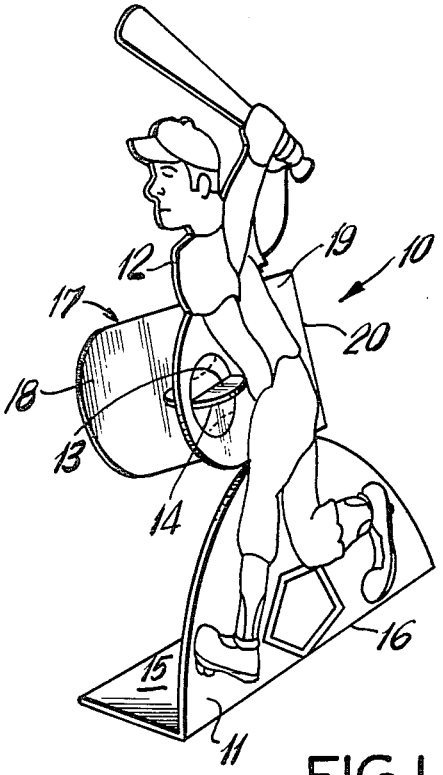
FIG. 1 is a front perspective view of the first embodiment of the toy of the present invention.

One embodiment of the toy of the present invention is shown in FIG. 1. The toy includes a flat body member formed of paperboard. For example, the toy may be die-stamped from cardboard.

The front face 11 of the body member 10 has the picture of a person playing a sport. In the illustrated case, shown in FIG. 1, the sport is baseball. The outline 12 of the body member 10 conforms to the drawing.

A slit 13 is formed in the body member and a flat member 14 is placed in the slit 13. The flat member 14 is formed of paperboard and represents the projectile used in the sport. In the embodiment of FIG. 1 the flat member 14 is round (as seen in top view) and is printed so that it resembles a baseball.

A paperboard base member 15 is preferably formed integrally with the body member 10 and is folded at a right angle to the body member 10 along the fold line 16. The base member 15 permits the toy to be self supporting in a standing position.

Figure 2:
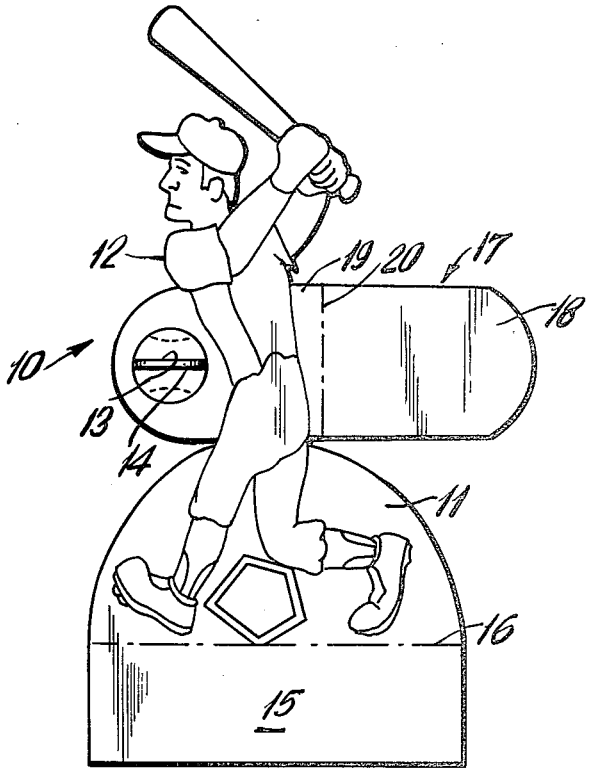
FIG. 2 is a top plan view of the paperboard blank from which the embodiment of FIG. 1 is formed.

A flipper arm member 17 is connected to the body member 10. The flipper arm member 17 consists of a swingable free end portion 18, an inner portion 19 connected to the body member 10, and a fold line 20 joining the two portions 18, 19. In the embodiment of FIGS. 1 and 2 the flipper arm member 17 is formed integrally with the body member 10 and may be stamped from the same sheet of cardboard.

Figure 3:
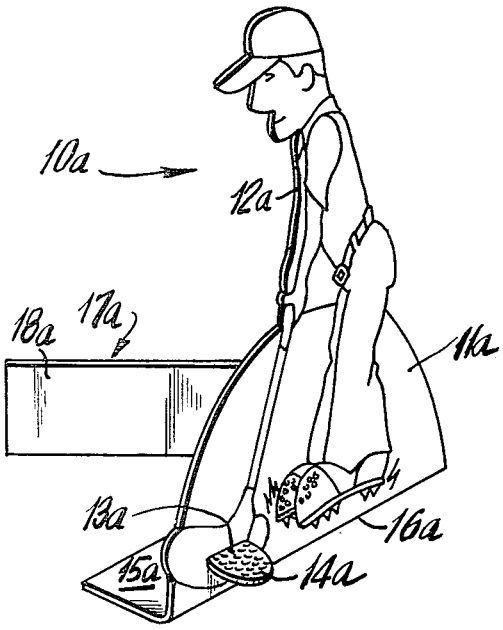
FIG. 3 is a front perspective view of the second embodiment of the present invention.
Figure 4:
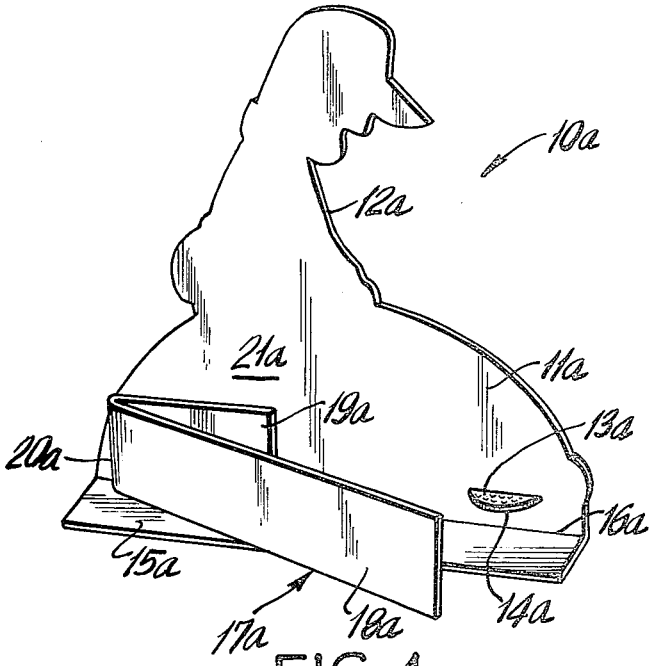
FIG. 4 is a rear perspective view of the embodiment of FIG. 3.

The embodiment shown in FIGS. 3 and 4 is similar in many respects to the embodiment shown in FIGS. 1 and 2, and its corresponding parts are labeled with the same number and the suffix "a".

The sports figure in the embodiment of FIGS. 3 and 4 is a golfer and the flat member **14*a*** is printed to resemble a golf ball.

In the embodiment of FIGS. 3 and 4 the inner portion **19*a* of the flipper arm member 17*a* is adhered to the rear face 21*a* of the body member 10*a***.

In operation, the child, in playing with the toy, inserts the flat member 14 in slit 13 so that part of the flat member 14 protrudes from the rear face of the body member 10. With his thumb he flips (rapidly pushes) the free end portion 18 of the flipper arm member so that it strikes the flat member propelling it, as a projectile, through the air. For example, the toy may be used on a sheet printed with lines indicating areas, with the object of the game to propel the flat member so that it lands in the desired area.

What is claimed is:

1. A toy comprising a flat paperboard body member having front and rear faces, said body member having an outline shape and printed indicia on its front face of a person engaging in a sport involving a projectile, a paperboard flat member representing the projectile of the said sport, a slit in said body member of sufficient length to temporarily hold said flat member, said flat member being positioned in said slit with a portion of said flat member protruding from the rear face of said body member, a paperboard flipper arm member having one portion secured to said body member, a swingable free end portion arranged to be flipped by the user to thereby strike the portion of the flat member protruding from said rear face, and a fold line joining said two flipper arm member portions to provide resiliency to the free end portion.

2. A toy as in claim 1 wherein said sport is baseball and the said flat member is printed to resemble a baseball.

3. A toy as in claim 1 wherein said sport is golf and the said flat member is printed to resemble a golf ball.

4. A toy as in claim 1 and further including a paperboard base member joined to said body by a fold line at a right angle thereto.

5. A toy as in claim 1 wherein said flipper member and said body member are integral members formed from a single paperboard blank.

* * * * *